United States Patent [19]

Mendoza

[11] 4,030,669

[45] June 21, 1977

[54] BURNER, ESPECIALLY FOR GASEOUS FUELS

[76] Inventor: Fausto Celorio Mendoza, Cumbres de Acultzingo No. 185, Mexico 10, D.F., Mexico

[22] Filed: Feb. 21, 1975

[21] Appl. No.: 551,659

[52] U.S. Cl. ..... 239/590; 239/597; 239/599

[51] Int. Cl.[2] ..... B05B 1/06

[58] Field of Search ..... 239/597–599, 239/601, 590, 553

[56] References Cited

UNITED STATES PATENTS

| | | | |
|---|---|---|---|
| 621,968 | 3/1899 | Kurtz | 239/597 |
| 637,850 | 11/1899 | Buerkle | 239/597 |
| 1,055,715 | 3/1913 | Dahl | 239/590 |
| 1,740,316 | 12/1929 | Ricardo | 239/553 |
| 2,289,432 | 7/1942 | Kammerer | 239/590 |
| 3,462,085 | 8/1969 | Nugarus | 239/601 |

*Primary Examiner*—Carroll B. Dority, Jr.
*Attorney, Agent, or Firm*—Albert L. Jeffers; Roger M. Rickert

[57] ABSTRACT

A burner, or nozzle, especially for gaseous fuels in which the burner is formed of inner and outer members defining therebetween an annular gap from which the gas to be burned is discharged while preceding the annular gap is an annular turbulence chamber preferably having a greater cross sectional area than that of the gap. The fuel to be burned is introduced in substantially the radial direction into the turbulence chamber and then is discharged through the gap and burns. The walls defining the turbulence chamber and gap advantageously converge toward the axis of the burner in a direction outwardly from the burner and, likewise, converge with each other.

3 Claims, 7 Drawing Figures

BURNER, ESPECIALLY FOR GASEOUS FUELS

The present invention relates to burners, or nozzles, especially for gaseous fuel, and is particularly concerned with such a burner which creates conditions in which the combustion of the fuel is more efficient and is, likewise, more or less directed during the burning operation.

Burners for fuels such as gaseous fuels are known, but heretofore the burners have been relatively inefficient so that not all of the fuel discharged therefrom undergoes combustion. Incomplete combustion of the fuels leads to the build-up of residues and the pollution of the atmosphere. Further, burners according to the prior art do not produce a concentrated or directed flame but produce a flame which is diffused and which, therefore, does not burn efficiently and is difficult to confine.

The principal objective of the present invention is the provision of a burner arrangement which avoids the drawbacks referred to above.

Another object is the provision of a burner, especially for gaseous fuel, which is operable to produce a concentrated flame of high intensity and high caloric content.

Still another object of the invention is the provision of a burner which does not require secondary air to promote efficient combustion.

Still another object is the provision of a burner of the nature referred to which is simple and inexpensive to construct.

A still further object of the invention is the provision of a burner which is capable of producing a continuous flame of fixed characteristics.

Still another object of the invention is the provision of a burner especially adapted for use with gaseous fuels which can be employed in the vicinity of other burners without any loss of efficiency.

Still another object is the provision of a burner which is movable into any position and which will not lose efficiency on account of the direction in which the flame emerges.

BRIEF SUMMARY OF THE INVENTION

According to the present invention, a burner is provided comprising an outer body part having a generally cylindrical recess in one end and a cylindrical shank protruding from the other end. An inner body is provided seated in the recess and having a hollow stem fitting within the aforementioned tubular shank. The outer wall of the inner body and the wall of the recess in the outer body define a turbulence chamber therebetween which tapers inwardly toward the open end of the recess to form a gap from which the fuel emerges for supporting the burner flame.

The fuel is supplied through the hollow stem of the inner body and then outwardly into the turbulence chamber in a region axially spaced from the aforementioned gap. Preferably, the outer wall of the inner body and the confining wall of the recess not only converge with each other toward the gap, but also converge with the central axis of the burner head in a direction toward the gap.

By supplying a suitable combustible mixture through the tubular stem into the turbulence chamber, an intimate mixture of combustible gas and combustion air containing oxygen is created so that the flame supported by the burner requires little or no secondary air whereby the flame can be maintained in a rarified atmosphere or in the immediate vicinity of other burners without any loss of efficiency.

The exact nature of the present invention will become more apparent upon reference to the following detailed specification taken in connection with the accompanying drawings in which.

DETAILED DESCRIPTION OF THE INVENTION

Figure 2:
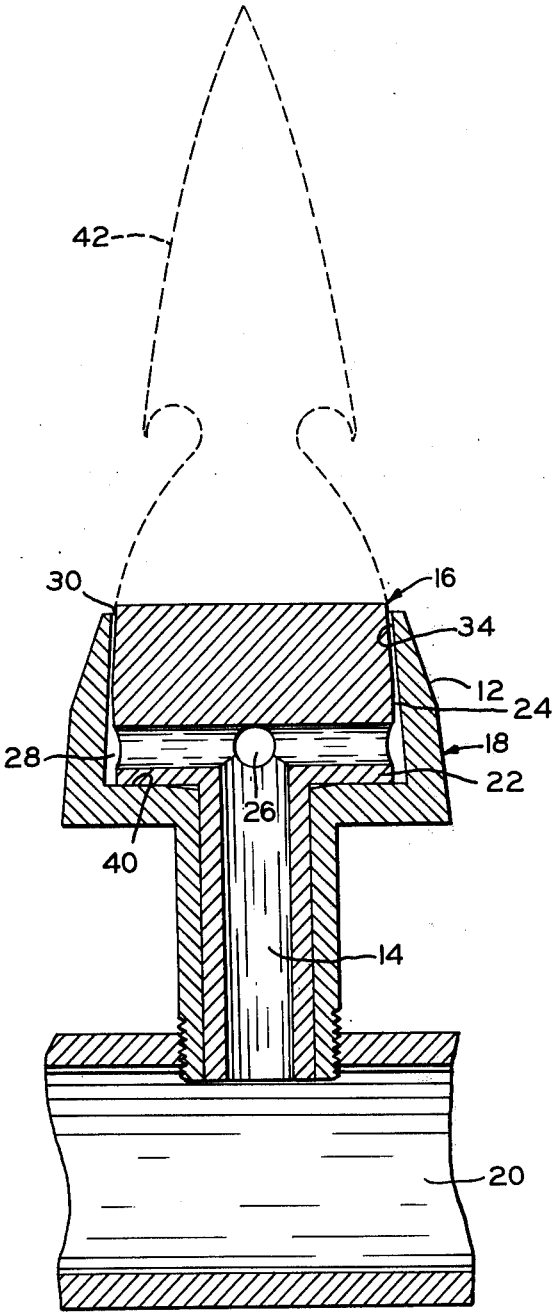
FIG. 2 is a vertical section through the burner showing details of construction thereof.

Referring to the drawings somewhat more in detail, the burner according to the present invention is generally indicated at 10 and comprises a main body portion 12 with a fuel supply conduit 14 through which fuel is supplied to the burner from a fuel supply pipe 20.

The burner consists of an inner body 16 having an outer generally cylindrical side wall 32 of which the upper portion 36 forms a segment of a cone while the lower portion 24 is substantially cylindrical. The aforementioned condition 14 extends axially through a stem portion formed on the rearward part of inner body 16 and intersecting conduit 14 are substantially radial conduits 26 which open through the outer wall of the inner member.

The burner, furthermore, comprises an outer member 18 having a generally cylindrical recess 34 therein with a tubular shank extending from the outer body part from the side opposite the open end of recess 34. It will be noted that the side wall of recess 34 converges with the axis of the outer body part toward the open side of the recess.

The recess 34 has a bottom wall 40 and in the region of the bottom of the recess 34 is the largest diameter portion 38 of the recess.

Figure 1:
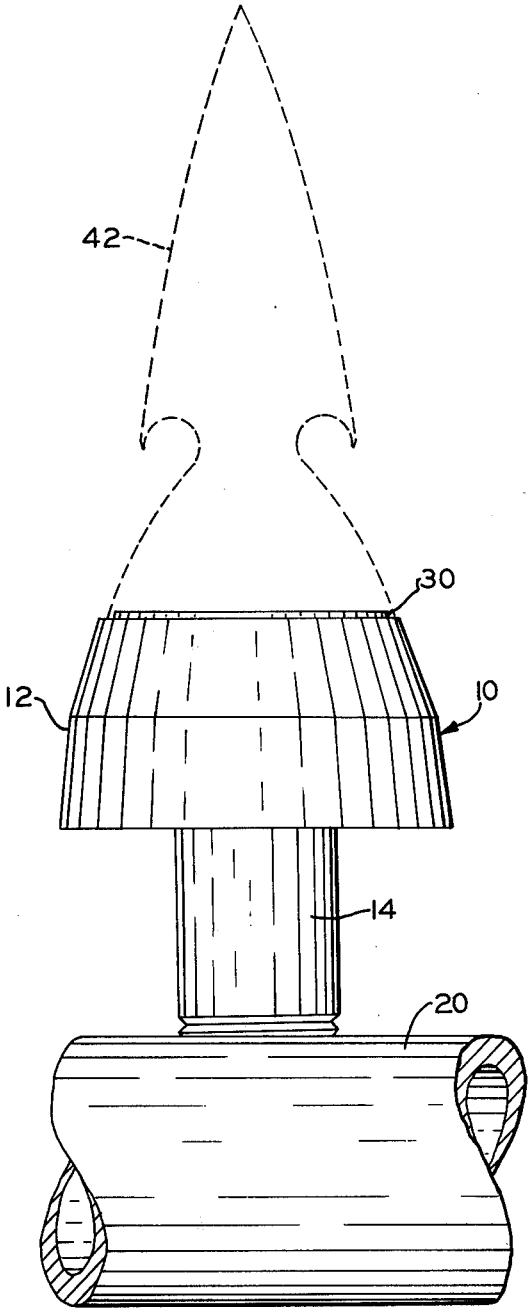
FIG. 1 is a side elevational view of a burner according to the present invention mounted on a fuel supply pipe.
Figure 3:
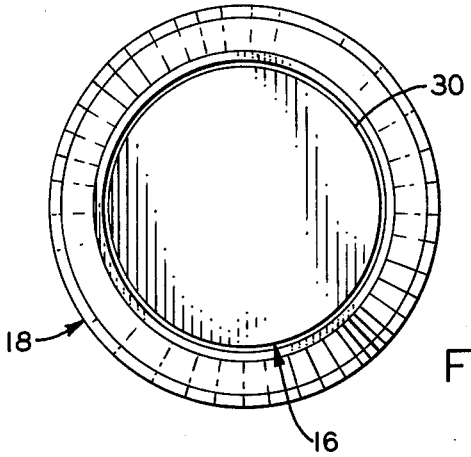
FIG. 3 is a plan view looking in at the outer end of the burner.
Figure 4:
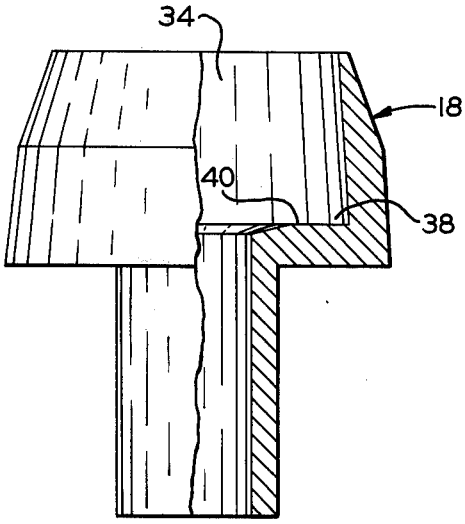
FIG. 4 is a view partly in section showing the outer body of the burner.
Figure 6:
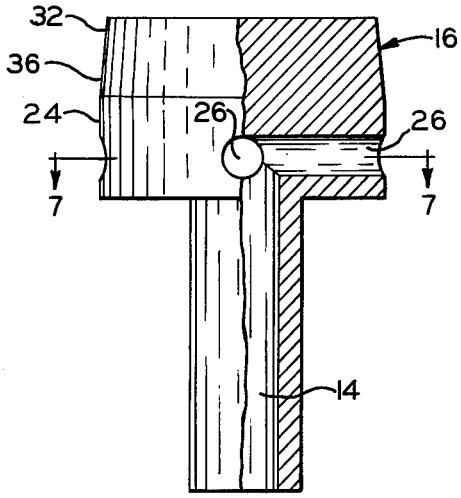
FIG. 6 is a side view partly in section of the inner body of the burner.
Figure 5:
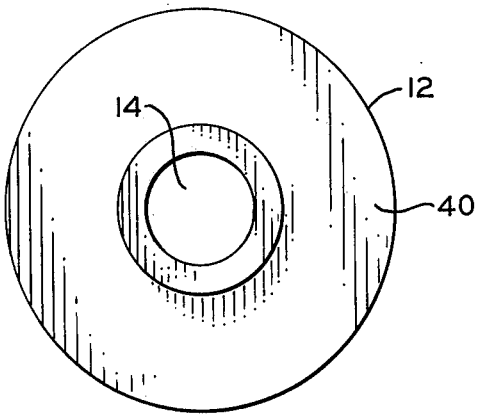
FIG. 5 is a view looking up from beneath FIG. 4.
Figure 7:
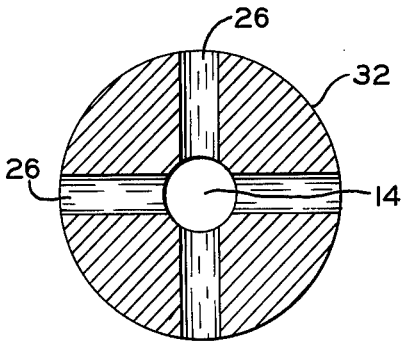
FIG. 7 is a sectional view indicated by line 7—7 on FIG. 6 and showing passages formed in the inner body.

The inner body part is assembled with the outer body part as shown in FIGS. 1 and 2 with the stem of the inner body part telescopically engaging the tubular shank of the outer body part and with the inner body part resting on the bottom wall 40 of recess 34 by virtue of a rearwardly facing shoulder formed on the inner body part where the tubular stem thereof intersects the main part of the body.

The tubular shank on the outer body part may be threaded so that it can be mounted in gas supply pipe 20 with supply pipe 20 in communication with conduit 14 in the stem of the inner body part.

When fuel under pressure is supplied to pipe 20, the fuel flows through conduit 14 and then outwardly through conduits 26 into a region of the turbulence chamber having the greatest cross sectional area. This turbulence chamber is indicated at 28 and is formed in the space between the inner and outer bodies.

The fuel, which becomes intimately admixed within the turbulence chamber, flows axially therefrom and out through the gap 30 formed between the inner and outer bodies at the open end of recess 34 and supplies the combustible mixture for maintaining flame 42. The gap 30, it will be noted, is annular and, due to the arrangement of the walls defining the gap so as to converge toward each other and also toward the axis of the burner, the flame is directed and confined, as indicated in the drawings, and it is, therefore, of high intensity and high caloric content.

The flame will have substantially the generally conical configuration shown in FIGS. 1 and 2 regardless of the direction in which the burner is directed. The fuel supplied to the burner includes the combustion air, or oxygen, required so that secondary air to be derived from the atmosphere surrounding the flame is maintained at a minimum while, furthermore, the burner can operate closely adjacent other burners without any decrease in efficiency.

Modifications may be made within the scope of the appended claims.

What is claimed is:

1. A burner, especially for gaseous fuels, comprising; an outer body, a recess formed into one end of said outer body having a side wall, an inner body disposed in said recess and having a side wall spaced from said side wall of said recess and forming a turbulence chamber surrounding said inner body, said side walls forming an annular gas discharge gap therebetween at the outer end of said recess, the side walls of said inner and outer bodies converging with the axis of said recess toward said gap, said recess having a shoulder at the bottom facing the open end of the recess, said inner body having a shoulder facing away from the open end of the recess and engaging the said shoulder at the bottom of the recess, said inner body having a flat end in about the plane of the open end of the recess, said outer body having a central tubular shank projecting therefrom at the end opposite said recess, said inner body having a stem fitted into said shank of said outer body, and conduit means for supplying gaseous fuel to the turbulence chamber in a region thereof spaced axially from said gap.

2. A burner according to claim 1 in which said shank includes means for connection of the burner to a gas supply pipe, said conduit means extending axially along said stem from the free end of the stem and then outwardly into said turbulence chamber.

3. A burner, especially for gaseous fuels, comprising; an outer body, a recess formed into one end of said outer body having a side wall, an inner body disposed in said recess and having a side wall spaced from said side wall of said recess and forming a turbulence chamber surrounding said inner body, said side walls forming an annular gas discharge gap therebetween at the outer end of said recess, the side walls of said inner and outer bodies converging with the axis of said recess toward said gap, and conduit means for supplying gaseous fuel to the turbulence chamber in a region thereof spaced axially from said gap including a first conduit extending axially into said inner member from the end thereof opposite the said gap and radial second conduits in said inner body connecting the first conduit with said turbulence chamber.

* * * * *